US005502902A

United States Patent [19]

Sussmann

[11] Patent Number: 5,502,902

[45] Date of Patent: Apr. 2, 1996

[54] SHOE WITH CENTRAL ROTARY CLOSURE

[75] Inventor: Reinhold Sussmann, Scheinfeld, Germany

[73] Assignee: Puma AG Rudolf Dassler Sport, Germany

[21] Appl. No.: 501,543

[22] Filed: Jul. 12, 1995

Related U.S. Application Data

[63] Continuation of Ser. No. 249,361, May 27, 1994, abandoned.

[30] Foreign Application Priority Data

Dec. 11, 1991 [JP] Japan ..... 3-109547
May 28, 1993 [DE] Germany ..... 9307479 U

[51] Int. Cl.[6] ..... A43C 11/20

[52] U.S. Cl. ..... 36/50.1; 36/54; 24/714.7

[58] Field of Search ..... 36/50.1, 50.5, 36/54; 24/714.7, 714.6, 714.8

[56] References Cited

U.S. PATENT DOCUMENTS

| | | | |
|---|---|---|---|
| 3,768,182 | 10/1973 | Powers | 36/54 X |
| 4,342,161 | 8/1982 | Schmohl | 36/128 X |
| 4,571,782 | 2/1986 | Ahn | 36/50.5 X |
| 4,811,500 | 3/1989 | Maccano | 36/91 |
| 5,117,567 | 6/1992 | Berger . | |
| 5,177,882 | 1/1993 | Berger . | |
| 5,181,331 | 1/1993 | Berger . | |
| 5,184,378 | 2/1993 | Batra . | |
| 5,319,868 | 6/1994 | Hallenbeck | 36/50.5 X |
| 5,325,613 | 7/1994 | Sussmann . | |
| 5,341,583 | 8/1994 | Hallenbeck | 36/50.1 |

*Primary Examiner*—Paul T. Sewell
*Assistant Examiner*—Ted Kavanaugh
*Attorney, Agent, or Firm*—Sixbey, Friedman, Leedom & Ferguson; David S. Safran

[57] ABSTRACT

A shoe with an upper made of resiliently flexible materials has a central rotary closure on an instep cover in an instep area of the upper, and a tightening element that is connected to the central rotary closure and which is guided from the instep cover laterally in the form of loops at each side of the upper. At each side of the upper, each of the loops is guided over a deflecting element of a respective guide element, so that the central rotary closure is able to shorten the tightening element, by rotating the central rotary closure, to close the shoe and to lengthen the tightening element to open the shoe. In accordance with a preferred embodiment of the invention, the deflecting element of each guide element is provided on a separate strap, a rear strap at each of medial and lateral sides of the shoe running obliquely downward and to the rear from instep cover toward the heel, a front strap on a medical side of the shoe running obliquely downward and to the rear toward a part of the shoe receiving the arch of the a wearer's foot and a front strap on a lateral side of the shoe running obliquely downward and to the rear toward a part of the shoe receiving the metatarsal outer ball of the wearer's foot.

19 Claims, 1 Drawing Sheet

SHOE WITH CENTRAL ROTARY CLOSURE

This application is a Continuation of Ser. No. 08/249, 361, filed May 27, 1994, now abandoned.

BACKGROUND OF THE INVENTION

1. Field of the Invention

This invention relates to a shoe, especially an athletic shoe, with a central rotary closure which is provided on an instep cover, and a tightening element that can drawn in and let out by the central rotary closure and is guided from the instep cover laterally and is looped over deflecting elements of guide elements that are located in the area of the side parts of the upper.

2. Description of Related Art

Shoes of the type to which the present invention is directed are known, for example, from U.S. Pat. Nos. 5,117,567 and 5,181,331. In the shoes described therein, the central rotary closure is attached to an instep cover, to which lateral closing flaps, for side parts of the upper, are molded-on in a hinged manner. The tightening element that can be tightened with the central rotary closure runs from the instep cover alternately over guide elements of the closing flaps and the instep cover.

Further, it is known from one embodiment of the previously mentioned patents and from U.S. Pat. No. 5,177,882 to make the closing flaps as separate parts from the instep cover. In this case, the guide elements are attached to lateral straps which run over the shoe upper to the area of the shoe sole and which connect to the closing flaps via corresponding recesses formed in the closing flaps.

Also, co-pending U.S. patent application Ser. No. 08/113, 661, filed Aug. 31, 1993, still pending describes a shoe having a central closure which is mounted on the instep cover, and with supporting straps and a tensioning strip having guide elements being integrated into a single unit for each side of the shoe that is separate and independent of the instep cover. In this case, a rear support strap runs from the tensioning strip to the rear of the heel partially encompassing it at the sole while a forward supporting strap runs to the area of the metatarsophalangeal joints.

SUMMARY OF THE INVENTION

The primary object of this invention is to simplify and thus to configure more economically the closing device for a shoe of the aforementioned type.

This object is achieved by providing deflecting elements on separate straps in the area of inside (medial side) and outside (lateral side) of the shoe of which a rear strap runs obliquely downward and to the rear from the instep cover toward the heel and a front strap of which runs obliquely downward and to the rear in the direction of the arch of the foot on the inside of the shoe and in the direction of metatarsal outer ball of the foot on the outside of the shoe. The configuration of the closing device according to the invention produces not only a saving of material and a reduction of the number of individual parts, but also makes possible a simpler assembly and a secure holding of the foot in the shoe.

These and further objects, features and advantages of the present invention will become apparent from the following description when taken in connection with the accompanying drawings which, for purposes of illustration only, show a single embodiment in accordance with the present invention.

BRIEF DESCRIPTION OF THE DRAWING

The sole FIGURE shows a side elevational view of the lateral side of a shoe according to the invention.

DETAILED DESCRIPTION OF THE PREFERRED EMBODIMENT

Figure 1:
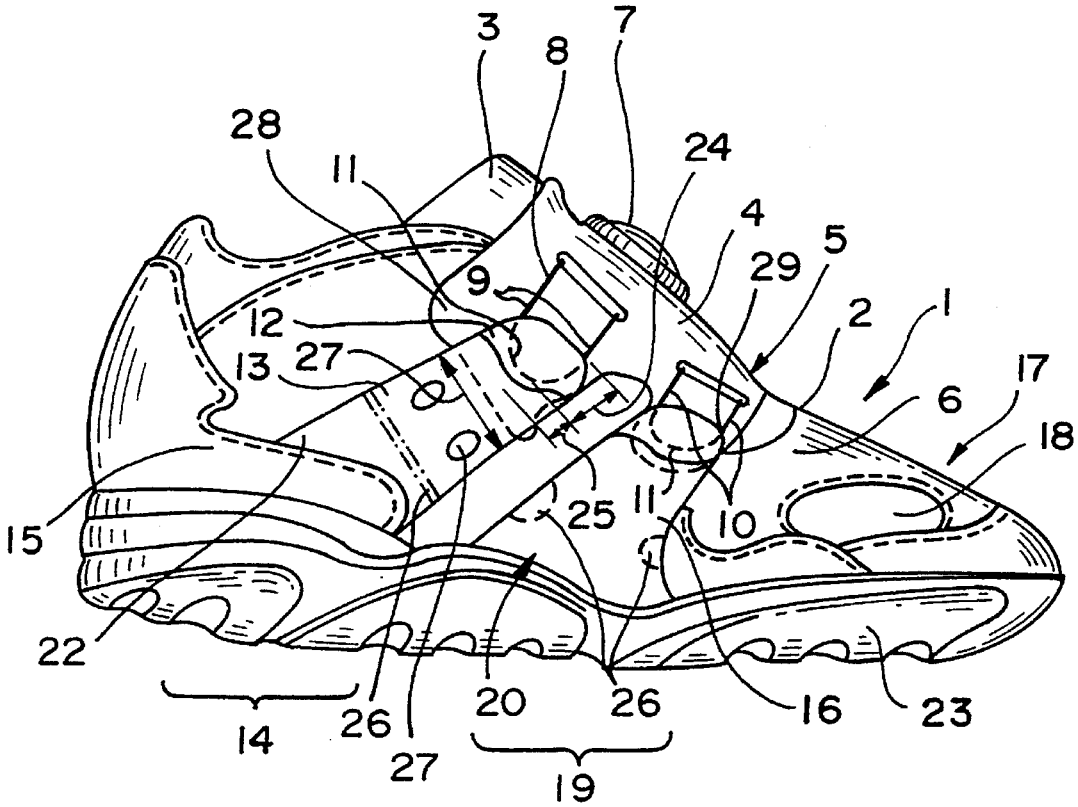

A shoe 1, especially a sport or leisure shoe, of the type having an upper formed of elastically flexible materials has an instep cover 4 made of a hard flexible material attached over an instep area 2 of the upper, preferably over or on a tongue 3 of shoe 1. Instep cover 4 is preferably fastened so as to be able to be swung upward and forward about its front edge. It can also be connected firmly, but preferably also in a manner able to be swung, with the tongue 3 or with a part of the upper 6 forming the tongue.

A central rotary closure 7, of a type of construction known in the art (e.g., of the type used on the shoes of the initially mentioned patents) is arranged on the instep cover 4. Preferably, a central rotary closure 7 is used, which can be released quickly by pulling or pressing on the winding knob thereof, or in another suitable way, to make possible a quick opening of the shoe 1.

A tightening element 8 in the form of a metal or plastic wire or rope of relatively small cross section is coupled with central rotary closure 7. On both sides of instep cover 4, this tightening element 8 is formed into a pair of spaced loops 9 and 10.

At each side of the shoe 1, rear, upper loop 9 is wound around a deflecting element 11 of a guide element 12. Guide element 12 is provided on a rear strap 13, which extends obliquely downward and to the rear from loop 9 to area 14 of the heel 15.

Front loop 10 is also wound around a deflecting element 11 of a guide element 12 which is provided on a front strap 16, which runs obliquely downward and to the rear from loop 10. On the inside 17 of the shoe, i.e., on the side of the shoe on which the inner malleolus of the foot is located, front strap 16 extends to the arch of the foot, and the front strap 16 runs over the outside 18 of the shoe, i.e., the side of the shoe on which the inner malleolus of the foot is located, in the direction of area 19 of the outside ball 20 of the metatarsus.

Starting from coupling element 12, the width 21 of straps 13, 16 increases linearly or disproportionately. Width 21 of straps 13, 16 at a top end thereof, preferably, corresponds at least approximately to the width of deflecting elements 11 of about 0.5 cm to 2.5 cm, and the width in lower end area 22 on shoe 1, on upper 6 or at sole 23, is about 2 cm to 9 cm, especially about 5 cm to 7 cm.

Straps 13, 16 are firmly connected, at least in end areas 22, with the shoe 1, upper 6 or sole 23. However, they can also be connected, for example, glued and/or sewn, with the upper of shoe 1 over a larger area, excluding area 24 of deflecting elements 11, and optionally also excluding adjacent section 25, of about 1 cm to 3 cm, thereby leaving the ends of the straps free, so that they can move and turn in any direction.

Straps 13, 16 preferably are formed of a flexible, slightly stretchable material, for example, of a fabric tape made of natural fibers or of plastic. Especially when using a nontextile material, such as leather, plastic or the like, the flexibility of straps 13, 16 can be increased, if necessary, by thinner and/or more narrow weak points 26 and/or by openings 27.

Coupling elements 12 are advantageously designed so that tightening element 8 can be inserted from the back side of coupling element 12 into the coupling element so as to run around the deflecting element 11. For example, for this purpose, the back side is cut open by a transverse slot, which is connected with a free space surrounding the deflecting element 11. In this regard, a suitable arrangement for achieving this result can be derived by reference to the construction of the guide element in the commonly assigned U.S. patent application Ser. No. 08/249,357, still pending, of Rudolf Hieblinger filed on even date herewith.

In an advantageous way, sliding extensions 28 or 29 are molded on the instep cover 4 so as to extend under the guide elements 11. The sliding extensions are dimensioned so that coupling elements 12 always rests thereon, i.e. through the full range of movement from the open position to completely closed position.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Shoe with an upper made of resiliently flexible materials, a central rotary closure, an instep cover in an instep area of the upper, said central rotary closure being provided on said instep cover, a tightening element connected to the central rotary closure, and guide elements at side parts of the upper, each of said guide elements having a deflecting element and said tightening element being guided from the instep cover laterally in the form of loops at each side of the upper, each loop being guided over the deflecting element of a respective one of the guide elements at the side parts of the upper, said central rotary closure forming a means for shortening the tightening element by rotating the central rotary closure to close the shoe and as a means for lengthening the tightening element to open the shoe; wherein the deflecting element of each guide element is provided on a free end of each of a plurality of separate straps, said separate straps comprising a rear strap at each of medial and lateral sides of the shoe running obliquely downward and to the rear from instep cover toward the heel, a front strap on a medial side of the shoe running obliquely downward and to the rear toward a part of the shoe receiving the arch of the a wearer's foot and a front strap on a lateral side of the shoe running obliquely downward and to the rear toward a part of the shoe receiving the metatarsal outer ball of the wearer's foot, the separate front and rear straps being firmly, connected with the shoe only at lower end areas thereof and excluding at least areas adjacent the deflecting elements; and wherein said instep cover is interconnected with the lateral sides of the shoe only via interaction of the loops of the tightening elements with the deflecting elements of the separate straps over which they are guided.

2. Shoe according to claim 1, wherein each strap has a width that increases from an initial minimum width, corresponding to a width of the deflecting element, at a free end of the strap at which the deflecting element is provided, to a width of about 2 cm to 9 cm at a lower end area of the strap at which it is fastened to the shoe.

3. Shoe according to claim 2, wherein each strap has a width of about 5 cm to 7 cm at said lower end area.

4. Shoe according to claim 2, wherein the straps are firmly connected with the shoe excluding an area encompassing the deflecting elements and up to 1 cm to 3 cm of an adjacent section of the upper.

5. Shoe according to claim 2, wherein the straps are firmly connected with the shoe only in said lower end area.

6. Shoe according to claim 2, wherein the straps are made of a flexible, slightly stretchable material.

7. Shoe according to claim 6, wherein the straps have points at which the material of which they are made has had the flexibility thereof increased by the provision of at least one of thinned and opened areas.

8. Shoe according to claim 2, wherein the instep cover has lateral extensions underlying the guide elements at both sides of the upper, the guide elements sliding on the lateral extensions throughout a full range of movement between a position thereof when the shoe is open and a position thereof when the shoe is closed.

9. Shoe according to claim 1, wherein the straps are firmly connected with the shoe excluding an area encompassing the deflecting elements and up to 1 cm to 3 cm of an adjacent section of the upper.

10. Shoe according to claim 1, wherein the straps are firmly connected with the shoe only in said lower end area.

11. Shoe according to claim 1, wherein the straps are made of a flexible, slightly stretchable material.

12. Shoe according to claim 11, wherein the straps have points at which the material of which they are made has had the flexibility thereof increased by the provision of at least one of thinned and opened areas.

13. Shoe according to claim 1, wherein the instep cover has lateral extensions underlying the guide elements at both sides of the upper, the guide elements sliding on the lateral extensions throughout a full range of movement between a position thereof when the shoe is open and a position thereof when the shoe is closed.

14. Shoe according to claim 13, wherein the straps are firmly connected with the shoe excluding an area encompassing the deflecting elements and up to 1 cm to 3 cm of an adjacent section of the upper.

15. Shoe according to claim 13, wherein the straps are firmly connected with the shoe only in said lower end area.

16. Shoe according to claim 13, wherein the straps are made of a flexible, slightly stretchable material.

17. Shoe according to claim 16, wherein the straps have points at which the material of which they are made has had the flexibility thereof increased by the provision of at least one of thinned and opened areas.

18. Shoe according to claim 13, wherein each strap has a width that increases from an initial minimum width, corresponding to a width of the deflecting element, at a free end of the strap at which the deflecting element is provided, to a width of about 2 cm to 9 cm at a lower end area of the strap at which it is fastened to the shoe.

19. Shoe according to claim 18, wherein each strap has a width of about 5 cm to 7 cm at said lower end area.

* * * * *

UNITED STATES PATENT AND TRADEMARK OFFICE

CERTIFICATE OF CORRECTION

PATENT NO. : 5,502,902

DATED : April 2, 1996

INVENTOR(S) : Reinhold SUSSMAN

It is certified that error appears in the above-indentified patent and that said Letters Patent is hereby corrected as shown below:

On the title page, in section [30], please delete the following:

"Dec. 11, 1991[JP] Japan 3-109547"

Signed and Sealed this

Eleventh Day of February, 1997

Bruce Lehman

*Attest:*

BRUCE LEHMAN

*Attesting Officer*

*Commissioner of Patents and Trademarks*